US005730532A

United States Patent [19]

Knabel et al.

[11] Patent Number: 5,730,532

[45] Date of Patent: Mar. 24, 1998

[54] BEARING ARRANGEMENT FOR AN OPEN-END SPINNING DEVICE

[75] Inventors: Manfred Knabel, Ingolstadt; Erich Bock, Wettstetten; Edmund Schuller, Ingolstadt, all of Germany

[73] Assignee: Rieter Ingolstadt Spinnereimaschinenbau AG, Ingolstadt, Germany

[21] Appl. No.: 807,912

[22] Filed: Feb. 28, 1997

[30] Foreign Application Priority Data

Mar. 5, 1996 [DE] Germany ..... 196 08 272.12

[51] Int. Cl.[6] ..... F16C 32/06

[52] U.S. Cl. ..... 384/121; 57/406; 384/549

[58] Field of Search ..... 384/121, 549, 384/913, 603; 57/406, 407

[56] References Cited

U.S. PATENT DOCUMENTS 5,098,205 3/1992 Zehnbauer et al. .
5,222,353 6/1993 Stahlecker ..... 57/406
5,450,718 9/1995 Knabel et al. ..... 57/406
5,522,211 6/1996 Knabel et al. ..... 384/406

OTHER PUBLICATIONS

German Search Report, Sep. 23, 1996.

Möglichkeiten des Verschleiss–Schutzes Bei Abrasiver und Adhäsiver Beanspruchung, Oberfläche–Surface, Jan. 19, 1978.

Kohlegrafit: Werkstoff Für Schmierstoffreie Dichtungen Und Lagerungen, Tribologic + Schmicrunstechnik, Jan. 4, 1992.

*Primary Examiner*—Lenard A. Footland
*Attorney, Agent, or Firm*—Dority & Manning

[57] ABSTRACT

An open-end spinning device with a spinning rotor is supported by a shaft in a bearing arrangement. An axially rearwardly directed force is exerted on the rotor shaft in operation of the spinning device. The end of the rotor shaft bears against an aerostatic bearing which includes a bearing surface oppositely facing the end of the rotor shaft made of a carbon material. The rotor shaft has a bearing surface defined on the end thereof opposite the aerostatic bearing which is made at least in part of a carbide material.

13 Claims, 1 Drawing Sheet

BEARING ARRANGEMENT FOR AN OPEN-END SPINNING DEVICE

BACKGROUND OF THE INVENTION

An open-end spinning device is known from DE-A 39 42 612 (U.S. Pat. No. 5,098,205) in which a spinning rotor is supported on its shaft by supporting disks and on which an axial force is exerted, whereby the axial support of the rotor shaft is effected via an aerostatic axial bearing. This aerostatic axial bearing is provided with a bearing plate which interacts with the shaft end. The air emerges from the bearing plate and constitutes an air cushion between the rotor shaft and the bearing plate. Together with the end of the rotor shaft the latter, thanks to appropriate materials, constitutes a low-friction material pairing. This is obtained, e.g., by means of a bearing plate made of a carbon material interacting with a steel rotor shaft, the bearing surface of which is milled flat and which has little rough depth. The carbon material is here essentially carbon graphite, but other suitable carbon materials with suitable mechanical characteristics could also be used.

In normal operation no contact occurs between the rotor shaft and the bearing plate, so that a wear-free axial bearing is provided. In the operation of open-end spinning rotors, operating condition of such roughness occur at time, e.g. because of imbalance of the spinning rotor, that a contact between the shaft end and the bearing plate of the aerostatic axial bearing occurs. This contact does not necessarily mean that the aerostatic bearing is damaged, since it is provided with a low-friction material pairing in the known open-end spinning device. Nevertheless, each contact between rotor shaft and the bearing plate of the axial plate produces a small amount of wear on the axial bearing, eventually limiting the duration of its life.

OBJECTS AND SUMMARY OF THE INVENTION

It is a principal object of the present application to perfect an open-end spinning device of the type mentioned above in such manner that wear is further reduced, whereby costs are to be kept low to insignificant. Additional objects and advantages of the invention will be set forth in part in the following description, or may be obvious from the description, or may be learned through practice of the invention.

By making the bearing surface of the shaft of carbide, the wear of the axial bearing, i.e. wear of the bearing plate is reduced considerably. A carbon material together with a carbide provide especially advantageous, low-friction, and low-wear pairing of materials. The life of an open-end spinning device with an aerostatic axial bearing can be extended considerably by the design according to the invention. Utilization of a boron carbide is especially advantageous since it has great hardness and causes little wear of the carbon material. Silicon carbide is an especially advantageous material to be used for the bearing surface of the shaft. Together with the carbon material of the bearing surface of the axial bearing, this constitutes an especially advantageous, low-friction pairing of materials which is especially wear-resistant even under load. By providing an extension made of a carbide at the end of the rotor shaft, the paring of material can be obtained independently of the material of the rotor shaft. The design is especially economical if, according to another embodiment, the bearing surface of the rotor shaft is coated with a carbide. The design of the bearing surface of the shaft is especially advantageous if it consists of a plane polished surface which is coated. This makes it possible to apply a very thin coating while ensuring at the same time that the geometric ratios in the axial bearing are advantageous. It is especially advantageous for the bearing surface of the shaft to be coated with carbide which is imbedded in a metal matrix, in particular a nickel matrix. In this manner, the shaft end can be provided with a carbide running surface in a simple and economical manner. It has been shown that it is sufficient for substantial extension of the life of the axial bearing, if the running surface is coated in such a manner. It is obviously not necessary for the entire running surface to be made of carbide. It is especially advantageous here if a sufficient proportion of carbide in the coating bath ensures that the bearing surface of the rotor shaft consists of carbide for at least 20% of its running surface. This proportion is already sufficient to achieve a considerable improvement in the life of the axial bearing. The bearing surface consists advantageously of 25% to 50% carbide. It is especially advantageous if the coating contains silicon carbide. In addition, the remaining shaft can be coated advantageously in one operation, so that the remaining areas of the shaft are wear-proof without causing additional costs. A grain size between 2 μm and 6 μm for the carbide grains in the coating is especially easy to integrate into the metal matrix and at the same time provides good running characteristics. The coating has good mechanical characteristics at a thickness between 10 μm and 30 μm.

The invention is explained in further detail below through drawings.

DETAILED DESCRIPTION OF THE PREFERRED EMBODIMENTS

Figure 1:
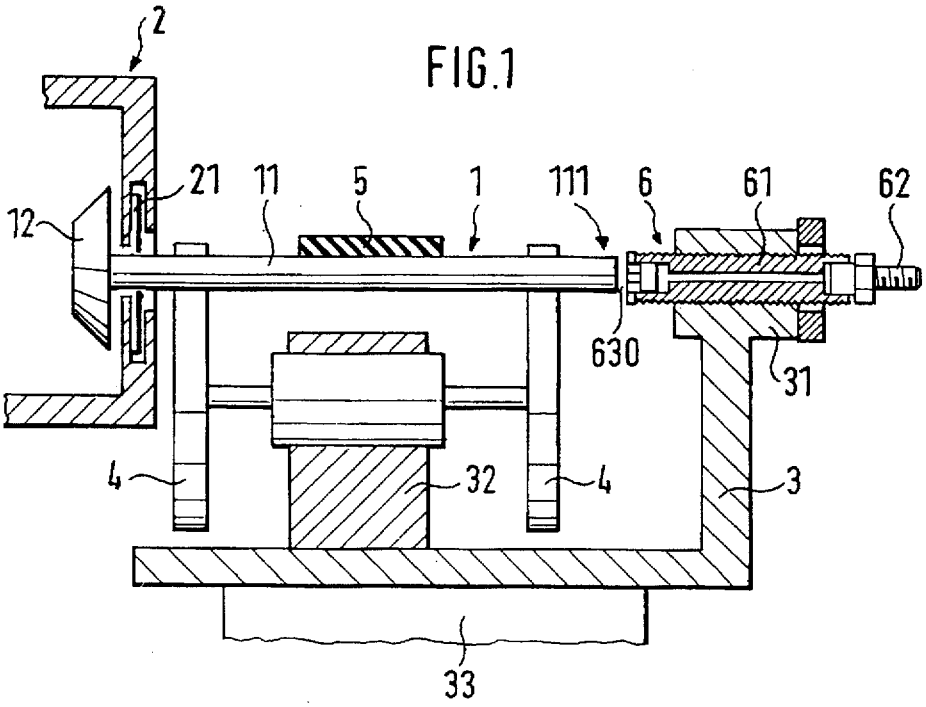
FIG. 1 shows a section through an open-end spinning device according to the invention.

Reference will now be made in detail to the presently preferred embodiments of the invention, one or more examples of which are illustrated in the drawings. Each example is provided by way of explanation of the invention, and not meant as a limitation of the invention. For example, features illustrated or described as part of one embodiment can be used on another embodiment to yield still a further embodiment. It is intended that the present application cover such modifications and variations of the invention.

FIG. 1 shows an section through an open-end spinning device equipped according to the invention. The essential components are the spinning rotor 1 with its shaft 11 and the rotor plate 12, the rotor housing with the rotor housing seal 21, the bearing block 3 with a seat 31 for the axial bearing 6 and a seat 32 for the support of the supporting disks 4, as well as the supporting disks 4 themselves. In addition, the drive means 5, a tangential belt and the axial bearing 6 for axial support of the rotor shaft 11 are shown. The rotor shaft 11 extends with its end bearing the rotor plate 12 into the rotor housing through the bore of the rotor housing seal 21. The axial bearing 6 is located in an adjusting screw 61 and is facing the free end 111 of the rotor shaft 11.The seat 31 is provided with a bore with threads into which the adjusting screw is adjustably screwed in the axial direction. To set the adjustment, a counter nut is used. At the other end of the adjusting screw 61, the connection 62 for the arrival of compressed air to the axial bearing 6 is installed. The bearing gap 630 extends between it and the shaft end 111. An axial force which bears upon the free end 111 of the rotor shaft 11 is applied in a known manner to spinning rotors of open-end spinning devices of this type. The axial force exerted upon the rotor or rotor shaft is applied in a known manner by supporting disks 4 set at an angle in the open-end spinning device shown in FIG. 1. It is however also possible to apply the axial force component, e.g., via a drive belt running at an angle relative to the rotor shaft or via a pressure or drive disk set at an angle. The open-end spinning device is attached on the seat 33 which is part of the appertaining spinning machine.

Figure 2A:
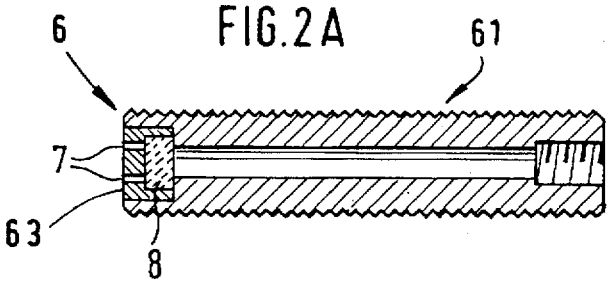
FIG. 2*a* shows a section through the axial bearing.

FIG. 2*a* shows a setting screw 61 and a bearing plate 63 of an aerostatic axial bearing 6 installed in same. Several bores 7 are provided in the bearing plate 63 in order to allow for air to escape. A throttle 8 made of a sintered material precedes the bores, so that the bearing is given great rigidity since the short air columns in the bores are barely compressible.

Figure 2B:
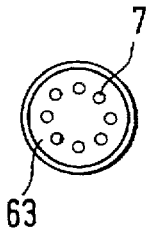
FIG. 2*b* shows a top view of the bearing plate of the axial bearing.

FIG. 2*b* shows the bearing plate 63 of FIG. 2*a* in a top view. The bores 7 are distributed evenly in a circular line at a distance from the center point. The bearing plate 63 is made of a carbon material such as, e.g., carbon graphite. The bearing plate could also be made of a coked or graphited carbon as well as of a carbon graphite material bound with synthetic resin.

Figure 3:
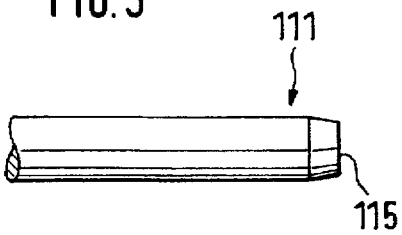
FIG. 3 shows the free end of a rotor shaft.

FIG. 3 shows a shaft end 111 of rotor shaft 11 designed according to the invention and interacting with the bearing plate of the axial bearing. The shaft end 111 has a plane-polished surface 115 which is coated with a carbide material. This may be, e.g., boron carbide or silicon carbide. For easy replacement of the spinning rotor, the shaft end 111 has a slightly smaller diameter than the rest of the shaft near the surface 115 so that the rotor shaft can be pushed more easily into the conical gap of the supporting disks when inserting the rotor into the open-end spinning device.

Figure 4:
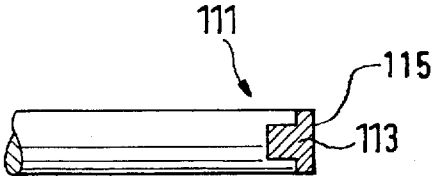
FIG. 4 shows a rotor shaft with an extension.

FIG. 4 shows the free end 111 of a rotor shaft made according to the invention, said free end 111 being provided with an extension 113 made of a carbide material. This may be, e.g., boron carbide or silicon carbide. The extension 113 is inserted into the suitably prepared end of the rotor shaft and attached by suitable connecting means, e.g. an adhesive. The bearing surface 115 is plane just as the bearing surface 115 of FIG. 3 consisting of a coating, and has little surface roughness. This, together with the carbide material, ensures that only very little wear takes place on the bearing plate. Aside from the embodiment of an extension shown in FIG. 4, such an extension can also be connected to the shaft without positive locking. This may be effected e.g. in that the extension is applied with a plane surface to the identically made surface of the rotor shaft end. Attachment in that case may be by means of an adhesive.

Figure 5:
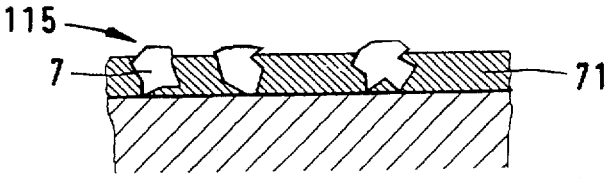
FIG. 5 shows a section through the bearing surface of the rotor shaft with a coating of carbide grains embedded in nickel.

FIG. 5 shows a section through the free end of a rotor shaft made according to the invention, the bearing surface 115 of which is made of carbide crystals 7 embedded in a metallic matrix 71 which in this case is made advantageously of nickel. Even though the entire bearing surface 115 does not consist of carbide, it has nevertheless been shown that even such a coating makes it possible to achieve the advantageous running characteristics between a carbide material and a bearing plate 63 made of a carbon material. It has been shown that already a surface that consists of only 20% of carbide is sufficient for this on the overall bearing surface 115. This type of design of the open-end spinning device according to the invention has furthermore the advantage that not only the bearing surface 115 of the rotor shaft 11, but in addition also the remaining surface of the rotor shaft can be coated, e.g., with silicon carbide in order to protect it with silicon carbide from wear. This wear occurs e.g. in the area of the tangential belt 5, near the supporting disks 4 or also near a brake which is not shown here.

It will be apparent to those skilled in the art that various modifications and variations can be made in the present invention without departing from the scope and spirit of the invention. The present application covers such modifications and variations as come within the scope of the appended claims and their equivalents.

We claim:

1. An open end spinning device, comprising:

a spinning rotor having a rotor plate attached on one end of a shaft supported for rotation by a bearing arrangement, wherein a rearwardly directed axial force is imparted to said shaft in a direction away from said rotor plate in operation of said spinning device;

an aerostatic bearing disposed facing a free end of said shaft opposite said rotor plate, said aerostatic bearing having a bearing surface directly opposite said free end of said shaft made substantially of a carbon material; and said free end of said shaft having a bearing surface directly opposite said aerostatic bearing surface that is formed at least in part of a carbide material.

2. The spinning device as in claim 1, wherein said shaft free end bearing surface is formed at least in part of boron carbide.

3. The spinning device as in claim 1, wherein said shaft free end bearing surface is formed at least in part of silicon carbide.

4. The spinning device as in claim 1, wherein said shaft free end bearing surface is defined on an extension member attached to said shaft.

5. The spinning device as in claim 1, wherein said shaft free end bearing surface is defined by a carbide coating applied to said shaft.

6. The spinning device as in claim 5, wherein said carbide coating is applied to a polished flat planar surface of said shaft.

7. The spinning device as in claim 5, wherein said coating comprises a carbide material embedded in a metal matrix.

8. The spinning device as in claim 7, wherein said metal matrix comprises a nickel matrix.

9. The spinning device as in claim 1, wherein said shaft free end bearing surface is formed of at least 20% of said carbide material.

10. The spinning device as in claim 1, wherein said shaft free end bearing surface is formed of generally between 25% to 50% of said carbide material.

11. The spinning device as in claim 1, wherein said shaft free end bearing surface is defined by a coating of a carbide material wherein said carbide material has a grain size of generally between 2 μm to 6 μm.

12. The spinning device as in claim 1, wherein said shaft free end bearing surface is defined by a coating of a carbide material wherein said coating has a thickness of generally between 10 μm and 30 μm.

13. The spinning device as in 1, wherein said rotor shaft comprises additional surfaces coated at least partially with a carbide material.

* * * * *